US006293204B1

(12) United States Patent
Regen

(10) Patent No.: US 6,293,204 B1
(45) Date of Patent: Sep. 25, 2001

(54) CODE-LABELED AMMUNITION

(76) Inventor: David M Regen, 4342 Sneed Ave., Nashville, TN (US) 37215

( * ) Notice: Subject to any disclaimer, the term of this patent is extended or adjusted under 35 U.S.C. 154(b) by 0 days.

(21) Appl. No.: 09/505,831

(22) Filed: Feb. 17, 2000

(51) Int. Cl.[7] ..... F42B 5/26; F42B 30/00

(52) U.S. Cl. ..... 102/430; 102/473; 102/501; 102/517

(58) Field of Search ..... 102/430, 473, 102/502, 517, 518

(56) References Cited

U.S. PATENT DOCUMENTS

| | | | | |
|---|---|---|---|---|
| 1,502,925 | * | 7/1924 | Stone . | |
| 1,650,908 | * | 11/1927 | Ramsey . | |
| 1,887,324 | * | 11/1932 | Pocoroba . | |
| 2,592,434 | * | 4/1952 | Krasnow | 102/92.5 |
| 4,150,624 | | 4/1979 | Hammond | 102/1 M |
| 4,222,330 | | 9/1980 | Krystyniak | 102/38 R |
| 4,924,078 | | 5/1990 | Sant' Anselmo | 235/494 |
| 5,485,789 | | 1/1996 | Collier | 102/501 |
| 5,511,483 | * | 4/1996 | Griffin, Jr. | 102/501 |
| 5,685,100 | * | 11/1997 | Atchison | 42/1.01 |
| 5,698,816 | * | 12/1997 | Roxby | 102/516 |
| 5,758,446 | * | 6/1998 | Atchison | 42/78 |

* cited by examiner

*Primary Examiner*—Charles T. Jordan
*Assistant Examiner*—Kimberly S Smith

(57) ABSTRACT

The invention is ammunition and ammunition components labeled so that either a projectile or a shell casing found at a crime scene can be associated with all documented handlers from the last documented recipient back to the manufacturer. The likely labeling code is a two-dimensional binary array with at least six cells (digits) in each dimension. Several different methods of imparting the label to a projectile at or near its rear end are described, some of which can be used in combination, including: adding a labeled identification member beneath the projectile's rear surface, embossing the projectile's rear surface, injecting pins through the projectile's rear end, embossing the projectile beneath the projectile's rear surface at a transition between metal layers of different melting temperatures, printing the projectile's rear surface with detectable material, etching the projectile's rear surface. Several different methods of imparting the label to the cylindrical wall of a shell casing are described, some of which can be used in combination, including: indenting from the outside to produce a braille-like symbol, printing on the outer surface with detectable material, printing on the inner surface with detectable material, etching on the outer surface, etching on the inner surface.

14 Claims, 2 Drawing Sheets

CODE-LABELED AMMUNITION

BACKGROUND OF THE INVENTION

1. Field of the Invention

This invention relates to fire-arm ammunition, specifically the means for identifying the sellers and buyers or, more generally, the providers and recipients of ammunition whose formed components are found at a crime scene or the site of military or law-enforcement action.

2. Description of the Related Art

Political conversations and news reports imply that forensic ballistics practice is still inefficient and uncertain. Associating a projectile or shell casing with a possible user requires recovery of a spent ammunition component with interpretable markings from the fire arm which discharged the ammunition, and it requires recovery of the fire arm. The latter may be associated with the owner or recent handler based on registration information or finger prints, respectively. This process would be much more efficient if the formed components of ammunition were code labeled and registered.

Roxby (U.S. Pat. No. 6,698,816) described a method for labeling ammunition projectiles wherein an identification member (IDM) in the form of a labeled disk is secured at the rear face of a bullet core by a cup-shaped copper jacket enclosing the rear part of the bullet core. Griffin (U.S. Pat. No. 5,511,483) described inclusion of an IDM in the form of a metal ring within the projectile. Collier (U.S. Pat. No. 5,485,789) described inclusion of an IDM within the projectile, the IDM being of any shape, any size and any material able to maintain its integrity in molten lead. Collier also suggested an identifiable chemical mixture incorporated into the lead. Hammond (U.S. Pat. No. 4,150,624) described a method wherein an IDM in the form of a rod or wafer is embedded within the projectile. The labeling methods involving formed IDMs should be effective, as the IDMs can bear codes with sufficient coding capacity, they are relatively tamper proof, and they should survive impact. Krystyniak (U.S. Pat. No. 4,222,330) described a method involving incorporation of magnetic particles of various Curie temperatures into the formed components of ammunition. It appears that this method and the chemical-mixture method of Collier would be difficult to implement and very limited in coding capacity compared with the other methods involving formed IDMs.

Disclosed herein are several methods for labeling formed components of ammunition with the two-dimensional binary array of Sant' Anselmo et al (U.S. Pat. No. 4,924,078), a coding symbol which would also be ideal for the IDMs of Roxby, Collier and Hammond.

BRIEF SUMMARY OF THE INVENTION

The invention disclosed herein involves labeling of the main formed components in a retail unit (i.e. a package) of ammunition or ammunition components and the retail unit's package with a high-capacity code which distinguishes that package and its contents from every other of the same physical characteristics (size, shape, chemical composition of projectiles and/or shell casings). This would provide a very useful forensic tool, provided commercial transfers of ammunition are registered as are commercial transfers of firearms. In a military or police context, it would be useful for inventory management and quality control.

Presented are several ways to label projectiles and shell casings with the binary-array code or any comparably versatile and robust code.

BRIEF DESCRIPTION OF SEVERAL VIEWS OF THE DRAWINGS

The drawings illustrate a type of code capable of symbolizing as many distinct numbers as might be required to label the retail units of any kind of ammunition or formed ammunition components manufactured during a century. The two-dimensional binary-array is simply a compact way of displaying a long binary number. Shown are 6×6 binary-array codes (36 digits) capable of symbolizing more than 68 billion different numbers, these examples symbolizing the number 17 180 954 628 (reading rightward from top left). A 7×7 binary array (49 digits) can symbolize more than $5\times10^{14}$ different numbers, and an 8×8 binary array (64 digits) can symbolize more than $10^{19}$ (more than ten trillion trillion) different numbers—this in the space required to show one or two language letters or Arabic numerals.

Figure 1:
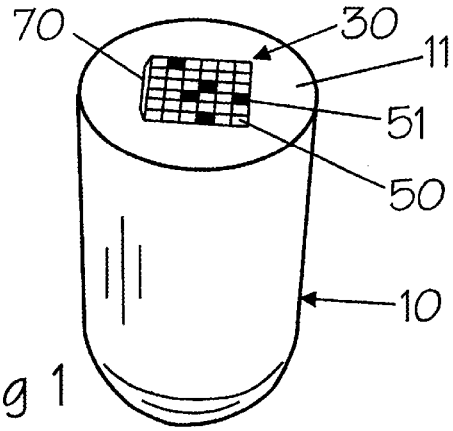
FIG. 1 shows a projectile labeled singly by printing or etching.

Reference Numerals in the FIGS.

10. Ammunition projectile
11. Rear face of ammunition projectile
20. Ammunition shell casing
21. Window cut away to expose inside to frame the code symbol surface of shell casing
30. Single binary-array code
31. Redundant binary-array code
50. Unmarked cell indicating 0
51. Marked cell indicating 1
70. Orientation symbol indicating left side
80. Corner mark outside of an array to frame the code symbol
90. Label-bearing object (identification member)
91. Constricted injection path

DETAILED DESCRIPTION OF THE INVENTION

Physical Attributes of a Typical Embodiment

Figure 10:
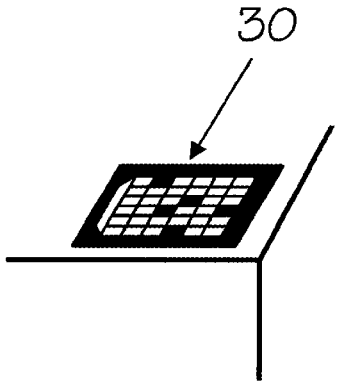
FIG. 10 shows a corner of a package bearing a printed code label.

The invention consists of ammunition (10,20) and its packaging (FIG. 10) labeled with two-dimensional binary arrays (30,31), such that a formed component (10,20) found at a crime scene can usually be identified with respect to its commercial transfers from manufacturer to retail buyer. The projectile (10) is labeled at or near its rear end (11), and the shell casing (20) is labeled on its cylindrical surface, its code being readable at least from the inner surface. The binary-array code (30) has at least six cells in each dimension, each cell being unmarked (50) indicating 0 or marked (51) indicating 1. A projectile's label needs an orientation symbol (70); but a shell-casing's label does not, though it may have one. The above features hold for all embodiments.

Figure 5A:
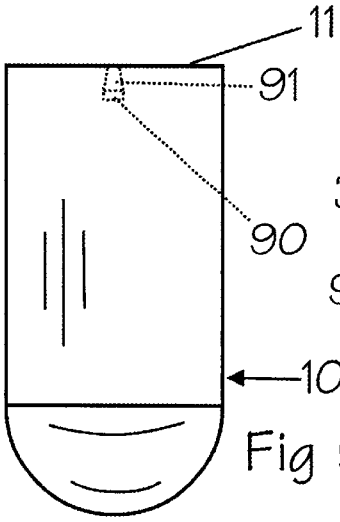
FIG. 5A shows a diagramed projectile into which a label-bearing object has been injected via the center of the projectile's rear end, the injection path being subsequently constricted.
Figure 5B:
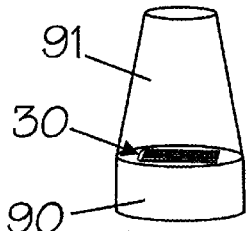
FIG. 5B shows a blown-up perspective view of the label-bearing object and constricted injection path.
Figure 7:
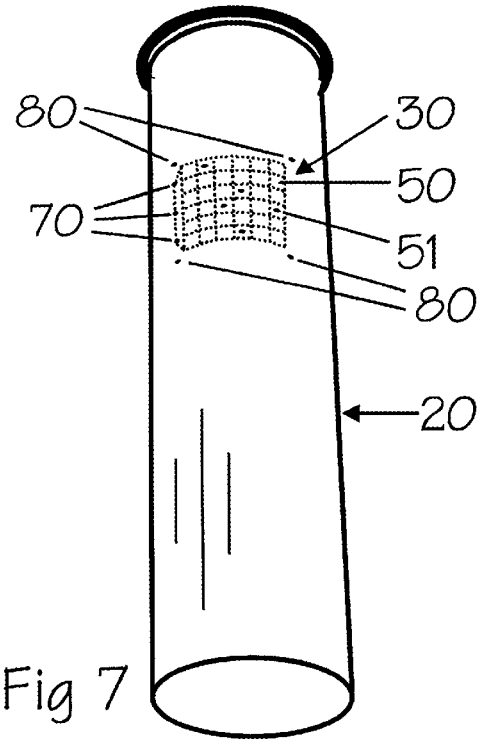
FIG. 7 shows a shell casing with a single braille-type label formed by point indentation from the outside and readable from either the outside or inside. The cell and orientation lines are optional, hence dotted.

In a typical embodiment, the projectile (10) is labeled by inclusion of a small, sufficiently tough label-bearing object (90), i.e. an identification member, near the projectile's rear end (FIG. 5). Its code (30) would probably be etched by laser and have the essential features of the one shown in FIG. 3. The shell casing's code consists of very small and very shallow dents centered in the "on" cells (51), with one such dent outside each corner of the symbol (80) to frame the code (FIG. 7). Cell spacing and orientation of the label on a given kind of shell casing are standardized, so the border lines (shown as dotted lines) and orientation symbol are optional.

Physical Attributes of Other Embodiments

The invented ammunition differs from conventional ammunition only in having its main formed components (10,20) labeled. The purpose of labeling is best realized if both the projectile (10) and shell casing (20) are labeled, since either formed component may be found at a crime scene. Alternative embodiments would involve labeling methods other than the typical ones, these being used instead of the typical ones to contain cost of labeling or in addition to the typical ones to ease code reading.

Figure 2:
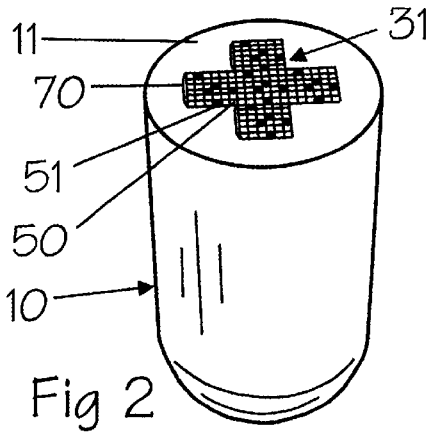
FIG. 2 shows a projectile labeled redundantly by printing or etching.
Figure 3:
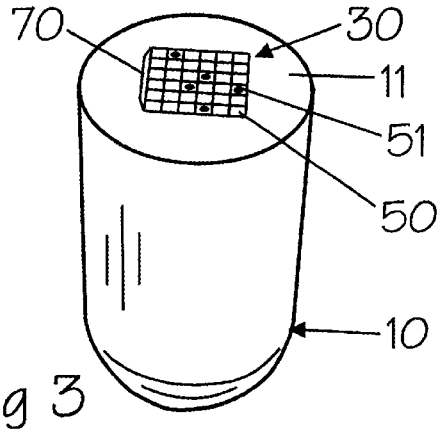
FIG. 3 shows a projectile labeled by embossing or etching.
Figure 4:
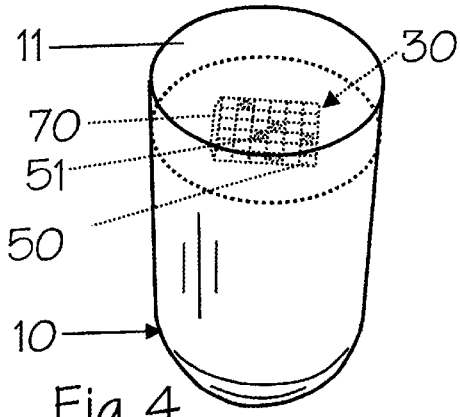
FIG. 4 shows a projectile labeled by embossing when most of its metal was poured and sufficiently hardened after which the projectile was completed with metal of lower melting point.
Figure 6:
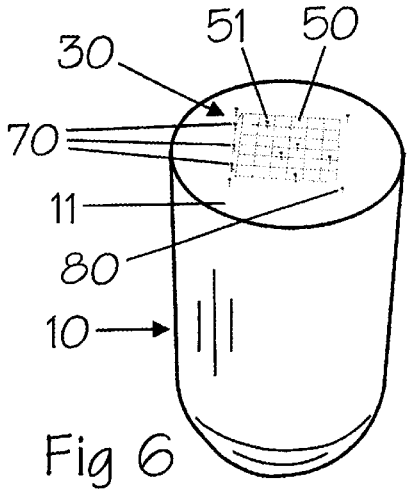
FIG. 6 shows a projectile in which key points of its label are represented by pins penetrating the projectile's rear end.

A projectile (10) may be embossed on its rear face (11), all features of the code (30) being recessed from the projectile's rear surface (FIG. 3). For more security, the code may be embossed on the rear end of the projectile with less than its full complement of metal, after which the rest of the projectile is poured with a metal of lower melting point (FIG. 4). A projectile may be labeled by printing with detectable material (visible or otherwise subject to imaging) or by etching (FIG. 1) instead of or in addition to other labeling methods. If printing or etching (any high-resolution technique) is used on a smooth rear surface, then the code may be present redundantly (31, FIG. 2). Moreover, a projectile may be labeled by inclusion of foreign matter such as small steel pins penetrating the projectile's rear end centered in the "on" cells (51) to form the code and at positions outside the cells to frame (80) and orient (70) the code symbol (FIG. 6). The pins would be approximately one millimeter in length.

Figure 8:
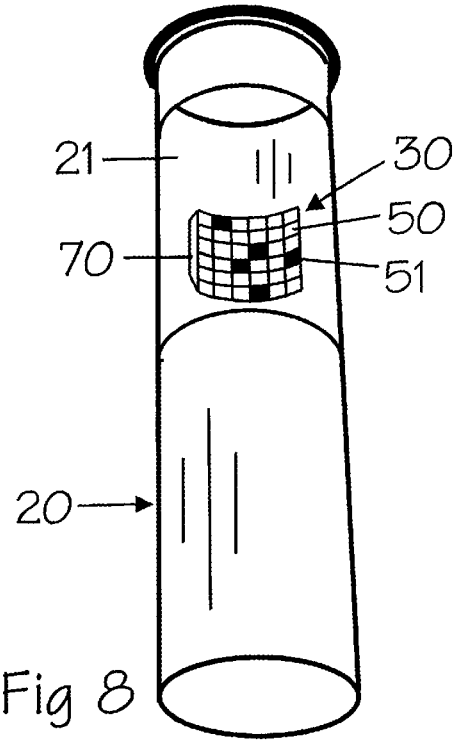
FIG. 8 shows a shell casing labeled on its inside surface by printing or etching, the opposite (near) side being cut away to expose the label.
Figure 9:
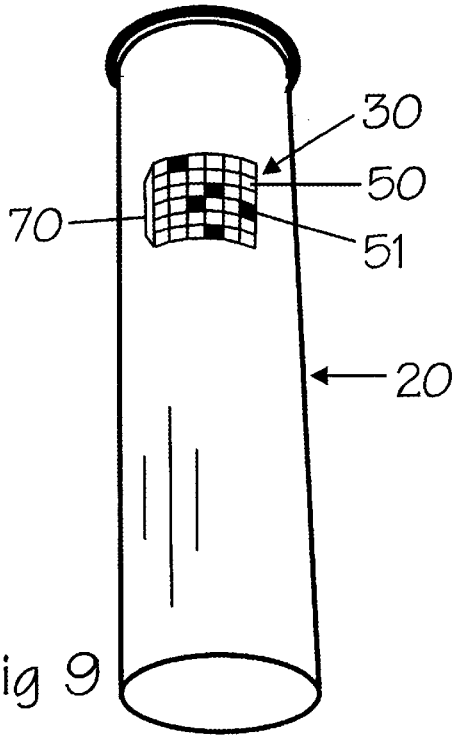
FIG. 9 shows a shell casing labeled on its outside surface by printing or etching.

A shell casing could be labeled by printing with detectable material or etching (FIG. 8, FIG. 9) instead of or in addition to braille-type indentation; and, if instead, the printed or etched label would be at least on the inner surface of the shell casing (FIG. 8).

Operation of Invention

With all of the main formed ammunition components in a retail unit (e.g. a box of ammunition or box of ammunition components) labeled with a given binary code (30) distinguishing the contents of that retail unit from every other of the same physical characteristics and with the unit's package correspondingly labeled, each provider in the distribution chain of that unit can (by use of a hand-held scanner) quickly register the provider (e.g. seller) and recipient (e.g. buyer) in every transaction involving the ammunition of that retail unit. The information can be automatically stored in a central data bank which can be used to track any projectile (10) or shell casing (20) found at a crime scene back through its distribution chain from retail buyer back to manufacturer. With ammunition-responsibility laws in place, the last recipient could be investigated. Even if the ammunition were stolen, knowing the last registered recipient should be useful, since the thief may be found. Therefore, code-labeled ammunition may lead to the solution of many fire-arm crimes which would otherwise go unsolved. Other uses of code-labeled ammunition would be to support inventory management and to reconstruct events at the site of a police action or military action (or fire-arm practice area) to evaluate equipment quality and human performance.

Several features distinguish the labeling methods disclosed herein from others. None of the cited patents teach a robust shell-casing label of high coding capacity (30). In fact, none of them identify a high-capacity code. The projectile labels described herein vary in production cost and effectiveness, but most should be cheeper than most of those described in detail in the cited patents. In the typical embodiment, the labeling of the projectile (10) occurs at the end of the molding step and would not complicate the molding process. The same could be said of the other embodiments except one (FIG. 4). The cited patents involve more disturbance of the projectile production process, and several of them involve more complicated accessories in the product. Of significance is the fact that forensic reading of the binary-array code (30,31) is done by eye after suitable magnification or imaging, and the binary-array code is interpretable despite substantial scarring, deformation or even fragmentation and reconstruction. That is, it will usually be possible to see whether a cell is marked or unmarked as long as one can identify the cell. If one cell were totally obscured, there would be two buyers to investigate; if two cells were totally obscured, there would be four buyers to investigate; etc. If the orientation symbol were totally obscured, there would be four buyers to investigate. Thus, the two-dimensional binary-array code espoused herein is inherently robust.

Possible Manufacturing Approaches

Devices for printing and reading two-dimensional binary-array codes (30) on packages (FIG. 10) are available already (Veritec Inc, 21345 Lassen St, Chatsworth Calif. 91311).

Tools and actions for labeling a projectile might be as follows: a) Injection of a small label-bearing object (labeled by a robotically controlled laser) into the projectile's rear face (FIG. 5) would be accomplished with the projectile still in its mold and warm, perhaps still soft in the middle. The working end of the injecting tool may consist of a driving rod (having essentially the diameter of the label-bearing object) coaxially in a close-fitting tube whose outer diameter is that of the projectile. With the rod in cocked position, the tube would be loaded by stepwise progression of a ribbon containing label-bearing objects as knock-out plugs, the ribbon being fed transversely through a cut out at or slot near the working end of the tube. The tube would be pressed against the projectile's rear end, the rod would be activated to force the label-bearing object (90) from the ribbon and into the projectile to a shallow depth. The driving rod would be withdrawn until it is flush with the tube, and the tube and rod together would press or tap the rear end of the projectile to constrict slightly the hole (injection path (91)) left by the driving rod. These actions would not corrupt the projectile's outer shape since the projectile would be in its mold throughout. b) The working end of a tool for embossing a complete (FIG. 3) or incomplete (FIG. 4) projectile in its mold would consist of walls forming a grid corresponding to the label's lines, the working edges of the walls being ridged. The spaces enclosed by the walls would be occupied by bars or rods sharpened conically or pyramidally on their working ends. The sharpened tip of a bar or rod would extend slightly beyond the ridges of the walls when positioned to mark a cell, or it would be retracted when positioned not to mark a cell. c) Detectable material (visible or subject to imaging) could be added to the embossing tool surfaces between stamping actions. d) An alternative tool, designed for injecting pins (FIG. 6), would be similar except that the rods or bars may be blunt and each would have an axial hole closely fitting a pin and a rod to drive the pin. Depending on the relative stiffness of the materials involved, it may be necessary to inject the pins while the projectile is still soft. e) The rear end of a projectile could be labeled with detectable material by use of a jet-printer head, and it could be etched by a robotically controlled laser (FIG. 1, FIG. 2).

Tools and actions for labeling a shell casing (20) might be as follows: a) It is expected that the tool for indenting a shell casing to produce a braille-type label (FIG. 7) would consist of a relatively unyielding clamp which closely surrounds much of the casing's cylindrical surface, the clamp having an array of holes radiating from it's inner surface into which round-tipped rods are positioned to hammer the casing's wall when activated. The hammer motion would be carefully controlled so as to produce the slightest dent detectable at the shell casing's inner surface. The rods would probably be activated sequentially rather than simultaneously, so as not to corrupt the casing's cylindrical shape; and for this same reason it may be necessary to support the casing from its inside surface with a brace having a cylindrical area closely fitting the casing's inner surface, that area bearing an array of recesses corresponding to potential dent sites. The brace would have to be precisely in register with the indentation tool. b) The label could be printed with visible or otherwise detectable material by use of a jet printing head properly shaped and positioned. The label could be etched by use of a robotically controlled laser (FIG. 8, FIG. 9). c) For labeling the inside surface of a shell casing (FIG. 8) the jet printing head or laser head would be oriented laterally or radially on the end of a stem.

The ammunition manufacturing process will need to be altered so as to label the formed components in the production line in a manner which ensures that those with a given label code number will end up together in a package bearing the same label code number.

Conclusion, Ramifications and Scope of Invention

Code-labeled ammunition should provide a powerful forensic tool which is apparently not in use today despite several patented ammunition-labeling techniques. Code-labeled ammunition should improve crime-solving efficiency and shorten criminal careers. Trackable ammunition might encourage legitimate buyers to better secure their ammunition. Code-labeled shell casings would be a powerful impediment to the use of automatic or semi-automatic weapons in crimes. Other benefits include inventory management and quality control in the military and other government agencies.

The forensic purpose of code-labeled projectiles can be circumvented by someone with a single-shot weapon who is able and willing to disassemble and reassemble ammunition, either tampering with the code or substituting privately molded projectiles. Private molding of projectiles would presumably be legal, but sale of unlabeled ammunition, projectiles or shell casings would be illegal after inventories in the pipeline are cleared. Possession of ammunition or its formed components with intentionally corrupted labels would be illegal.

What is claimed is:

1. Ammunition comprising a shell casing with a cylindrical wall and a projectile with a blunt rear end as its main formed components, the shell casing having at least one number-symbolizing code label on the inner surface of the shell casing's cylindrical wall and the projectile having at least one number-symbolizing code label essentially at the projectile's rear end.

2. The ammunition of claim 1, wherein each said number-symbolizing code is a two-dimensional binary array.

3. The ammunition of claim 2, wherein said shell casing bears a label comprised of braille-type indentations of the shell, casing's cylindrical wall and said projectile contains a label-bearing identification member near the projectile's rear end.

4. The ammunition of claim 2, wherein said label of said projectile is borne by an identification member within the projectile and near the projectile's rear end.

5. The ammunition of claim 2, wherein said label of said projectile is printed at least once on said projectile's rear end with print medium selected from the group consisting of readily visible print medium and print medium whose visualization can be greatly enhanced in a laboratory.

6. The ammunition of claim 2, wherein said label of said projectile is etched at least once on said projectile's rear end.

7. The ammunition of claim 2, wherein said label of said projectile is embossed on said projectile's rear end.

8. The ammunition of claim 2, wherein elements of said label of said projectile are comprised of pins of foreign material embedded in said projectile's rear end.

9. The ammunition of claim 2, wherein said projectile is comprised of at least two metal layers of differing melting temperatures, at least one said label being embossed on a layer of higher melting temperature at a transition between two such metal layers.

10. An ammunition shell casing with a cylindrical wall having at least one number-symbolizing code label on the inner surface of the shell casing's cylindrical wall.

11. The shell casing of claim 10, wherein said number-symbolizing code is a two-dimensional binary array.

12. The shell casing of claim 11, wherein said shell casing bears a label comprised of braille-type indentations of the shell casing's cylindrical wall.

13. The shell casing of claim 11, wherein said label is printed at least once on the shell casing's outer surface with print medium selected from the group consisting of readily visible print medium and print medium whose visualization can be greatly enhanced in a laboratory.

14. The shell casing of claim 11, wherein said label is etched at least once on the shell casing's outer surface.

* * * * *